United States Patent [19]

Baldino et al.

[11] Patent Number: 4,706,554

[45] Date of Patent: Nov. 17, 1987

[54] VERTICAL LOUVER SYSTEM FOR COOLING TOWERS

[75] Inventors: Micheal Baldino, Omaha; Robert L. Voss; Larry L. Hladik, both of Fremont, all of Nebr.

[73] Assignee: Kelly Industries, Inc., Fremont, Nebr.

[21] Appl. No.: 897,394

[22] Filed: Aug. 15, 1986

[51] Int. Cl.[4] ..... F24F 13/08

[52] U.S. Cl. ..... 98/121.2; 261/109; 261/DIG. 11

[58] Field of Search ..... 98/121.2; 261/109, DIG. 11

[56] References Cited

U.S. PATENT DOCUMENTS

| | | | |
|---|---|---|---|
| 1,907,330 | 5/1933 | Martin | 261/DIG. 11 X |
| 2,854,090 | 9/1958 | Slough | 261/109 |
| 3,117,170 | 1/1964 | Mart et al. | 261/DIG. 11 X |
| 3,933,196 | 1/1976 | Heller et al. | 261/DIG. 11 X |
| 4,173,605 | 11/1979 | Long | 98/121.1 X |
| 4,418,023 | 11/1983 | Dolan | 261/DIG. 11 X |
| 4,628,801 | 12/1986 | Hashimoto | 98/121.2 X |

FOREIGN PATENT DOCUMENTS

| | | | |
|---|---|---|---|
| 2566882 | 1/1986 | France | 98/121.1 |

*Primary Examiner*—Albert J. Makay
*Assistant Examiner*—Steven E. Warner
*Attorney, Agent, or Firm*—Kokjer, Kircher, Bradley, Wharton, Bowman & Johnson

[57] ABSTRACT

A system of vertical louvers for installation on a cooling tower having fixed horizontal slats. The louvers are mounted side by side for opening and closing movement about vertical axes. When closed, the louvers block the air spaces between the slats. When open or partially open, the air spaces are exposed to varying degrees in order to provide control of the pattern of air flow through the cooling tower. The louvers are mounted between concrete or wood beams of the cooling tower by a steam of angle brackets, pins or bolts.

18 Claims, 5 Drawing Figures

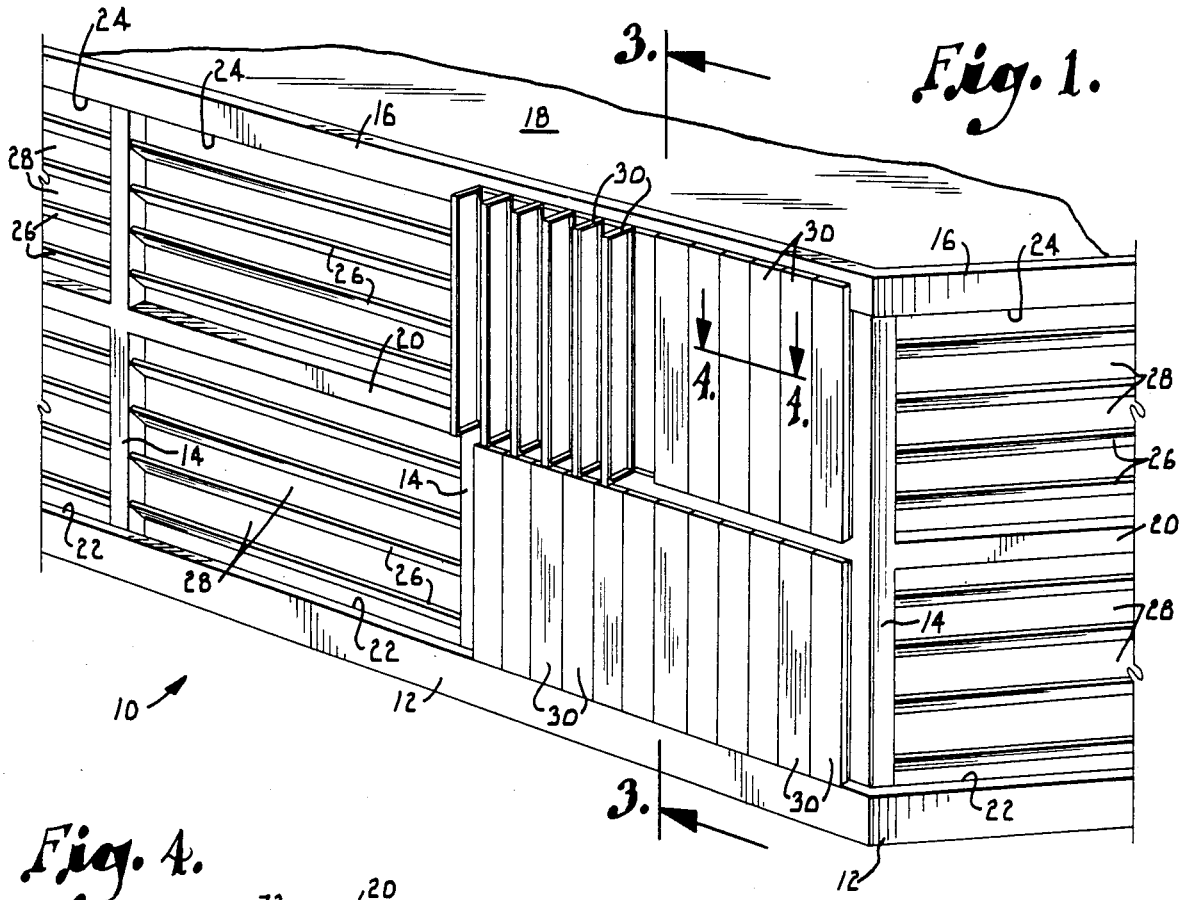
Fig. 1.
Fig. 4.
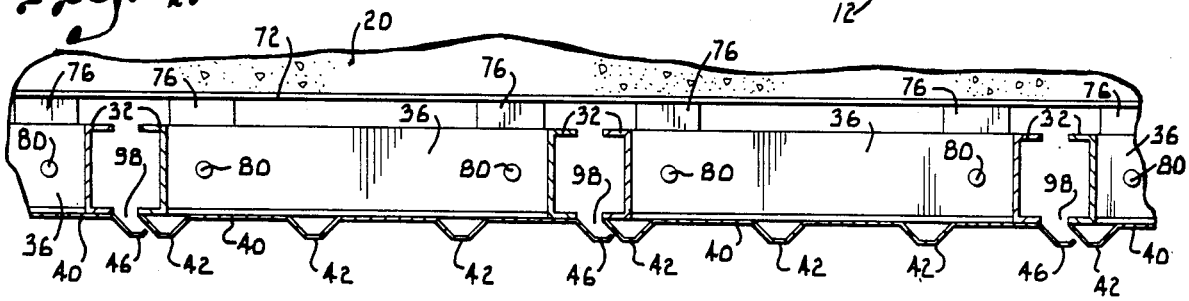
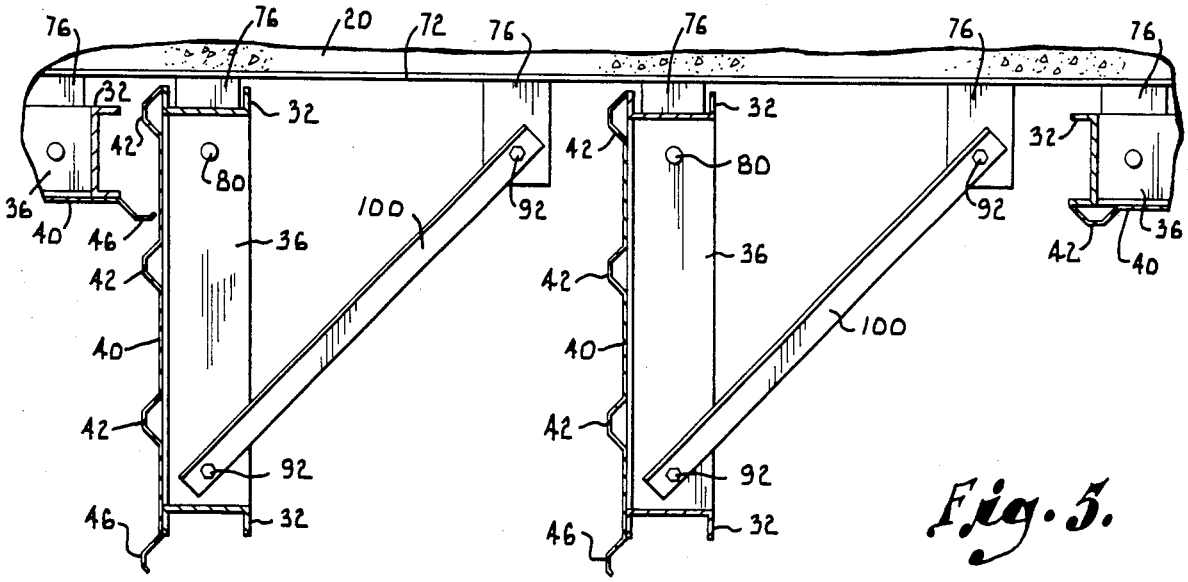
Fig. 5.

VERTICAL LOUVER SYSTEM FOR COOLING TOWERS

BACKGROUND OF THE INVENTION

This invention relates in general to cooling towers and deals more particularly with a system of vertical louvers which can be installed on a cooling tower for the purpose of totally or partially enclosing the tower to control the flow of air through it.

In a cross flow natural draft evaporative type cooling tower, the water that is to be cooled is delivered to a hot water basin and is allowed to gravitate through an underlying fill toward a cold water basin at the base of the tower. The "fill" is that portion of a cooling tower which represents its primary heat transfer surface, sometimes referred to as "packing". Ambient air flows through the water as it gravitates through the fill, and the water is thereby cooled by a combination of evaporative effects and sensible heat exchange. The ambient air enters the cooling tower through air spaces presented between horizontal louvers or slats mounted on the sides of the tower.

In cold weather climates, it is necessary in the winter at times to control the air flow by closing off some or all of the air spaces in order to control the formation of "unacceptable" ice. "Unacceptable" ice can be categorized as either a significant amount of ice that has formed on the fill, jeopardizing the operation and existence of the heat transfer surface; or excessive ice in a support region which may threaten the tower structure. The potential for ice varies directly with the quantity of air flowing through the tower, and reducing the air flow retards the formation of ice. This can be done by constructing the horizontal slats such that they are pivotal between open and closed positions. However, this makes the louver system much more expensive and, consequently, it is more common for the louvers to be fixed slats which cannot be adjusted to control the air spaces. With a fixed slat arrangement, it is sometimes necessary in cold weather to mount temporary panels on the cooling tower for covering of at least some of the air spaces and often all or most of them. The need to repeatedly install and remove the temporary panels results in significant labor and equipment requirements which add appreciably to the overall cost of operating the cooling tower. In addition, the temporary panels must be stored while not in use and must be repeatedly transported to and from the storage location.

SUMMARY OF THE INVENTION

The present invention is directed to a system of vertical louvers that are mounted side by side on an existing cooling tower which is already equipped with fixed horizontal slats for controlling the air flow. The added louvers are installed on the outside of the cooling tower where they enclose the slats when the louvers are closed. The louvers can be pivoted open or partially open to expose the air spaces between the slats, and the louvers thus serve to control the air flow through the cooling tower. Each louver can be opened or closed independently of the other louvers, and this provides the capability of achieving virtually any desired pattern of air flow through the tower.

Each louver takes the form of a rectangular panel having a rigid frame covered by a fluted sheet. Depending on the air flow pattern desired, the fluted sheet can cover the entire rectangular panel or only a portion thereof. This construction is economical while at the same time assuring that the louver panels have adequate strength to withstand the loads that are applied to them while in service. The primary structural strength of the rigid frame is provided by steel channels oriented to allow edge attachment to the fluted sheet while permitting pivotal louver movement between the open and closed position. The louvers also stack neatly and compactly for easy transport and storage. Each louver has a projecting lip on one side of its sheet for covering the gap between adjacent louvers without interfering with their pivotal movement between the open and closed positions. The louvers are mounted on the cooling tower by a unique system of brackets, pins and bolts which permit the louvers to be quickly and easily installed.

DESCRIPTION OF THE DRAWINGS

In the accompanying drawings which form a part of the specification and are to be read in conjunction therewith and in which like reference numerals are used to indicate like parts in the various views:

FIG. 1 is a fragmentary perspective view of a cooling tower which is partially equipped with a system of louver panels constructed according to a preferred embodiment of the present invention, with some of the louvers open and the remainder closed;

FIG. 4 is a fragmentary sectional view on an enlarged scale taken generally along line 4—4 of FIG. 1 in the direction of the arrows and showing a pair of the louver panels in the closed position; and FIG. 5 is a fragmentary sectional view similar to FIG. 4 but showing the two louver panels in the open position.

DETAILED DESCRIPTION OF THE INVENTION

Figure 2:
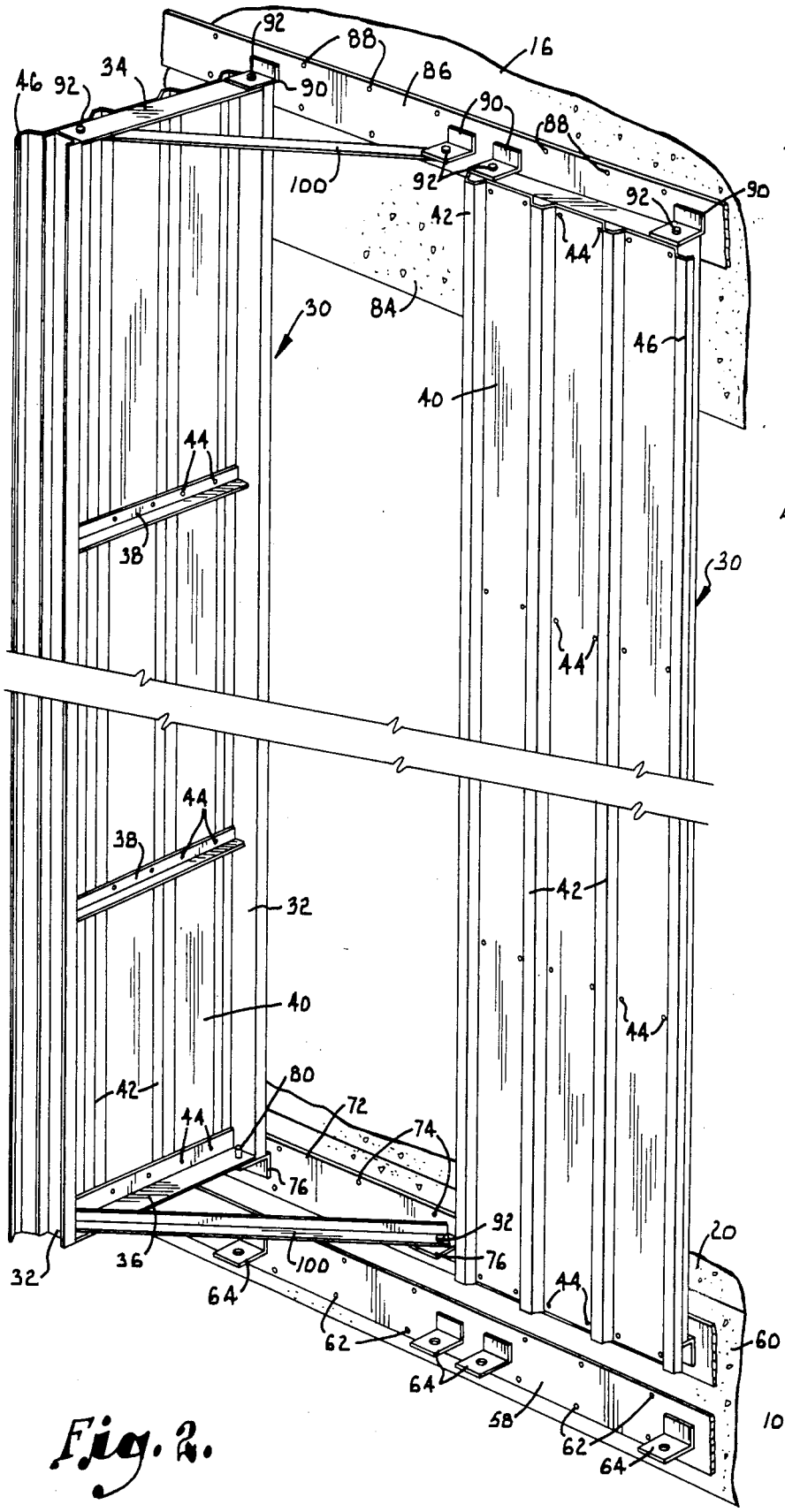
FIG. 2 is a fragmentary perspective view on an enlarged scale showing two of the louvers installed side by side on the upper section of the tower wall, with one louver in the closed position and one in the open position and the break lines indicating continuous length of the louver panels.

Referring now to the drawings in more detail and initially to FIG. 1, numeral 10 generally designates a cooling tower which may be a conventional evaporative type cooling tower. The structural framework for the cooling tower 10 includes a series of horizontal beams and vertical columns all of which may be constructed of reinforced concrete (or wood or steel or another structural material). The horizontal beam members of the framework include a concrete curb 12 within which a cold water basin is formed. Spaced apart vertical columns 14 extend upwardly from the curb 12 and are connected at their top ends with a horizontal beam or parapet 16 which extend around a hot water basin 18. An intermediate concrete horizontal beam 20 extends between adjacent columns 14 at a location approximately midway between the curb 12 and the parapet 16.

A rectangular opening is provided between each pair of adjacent columns 14 and beams. For example, lower rectangular openings 22 are formed between each adjacent pair of columns 14 and between curb 12 and the intermediate beam 20. Upper rectangular openings 24 are formed between adjacent pairs of columns 14 and between beam 20 and parapet 16. A plurality of fixed slats 26 extend horizontally across each opening 22 and 24. The slats 26 are each fixed at opposite ends to the columns 14, and each slat 26 is inclined upwardly from its inside edge to its outside edge at an angle of approximately 45°. The slats 26 are spaced apart in order to present a plurality of air spaces 28 within each of the openings 22 and 24. The air spaces 28 allow ambient air to enter the interior of the cooling tower for cooling of the water.

As thus far described, the cooling tower 10 is constructed in a conventional manner, and it operates in a well known fashion to cool water by the evaporation that takes place when air and water are brought into direct contact.

In accordance with the present invention, each opening 22 and 24 is provided with a series of louvers 30 which control the ingress of air through the opening. The louvers are arranged in two courses, an upper course which covers the upper openings 24 and a lower course which covers the lower openings 22. As best shown in FIG. 2, each louver 30 is formed as a rectangular panel having a rigid rectangular frame formed by a pair or metal channels 32 on its opposite sides, a horizontal angle member 34 extending between channels 32 at their top ends, and another horizontal angle member 36 which extends between the bottom ends of channels 32. Intermediate braces 38 are secured in extension between the channels 32 and take the form of angle members oriented parallel to the upper and lower angles 34 and 36. The non-sheeted face of each louver panel may also be provided with angle members (not shown) which add rigidity and provide compression resistance to the flanges of the panel. The angles and channels in the framework for each louver 30 may be welded together or secured in any other suitable manner.

On its outer face, the framework of each louver 30 is provided with a rectangular sheet 40 which is preferably sheet metal but may be plastic or any other suitable material. Each sheet 40 is generally planar and includes a plurality of vertical flutes 42 which present ribs projecting outwardly from the outer face of the sheet and corresponding grooves in the inside face of the sheet. Each sheet 40 is secured to the frame members of the louver by a plurality of fasteners 44 which may be rivets or screws. Each sheet is secured to its frame with the edges of the sheet extending along the upper and lower angles 34 and 36 and one of the channels 32. Sheet 40 projects sidewardly beyond the other channel 32 to present a projecting lip 46 which preferably forms part of one of the flutes 42.

Figure 3:
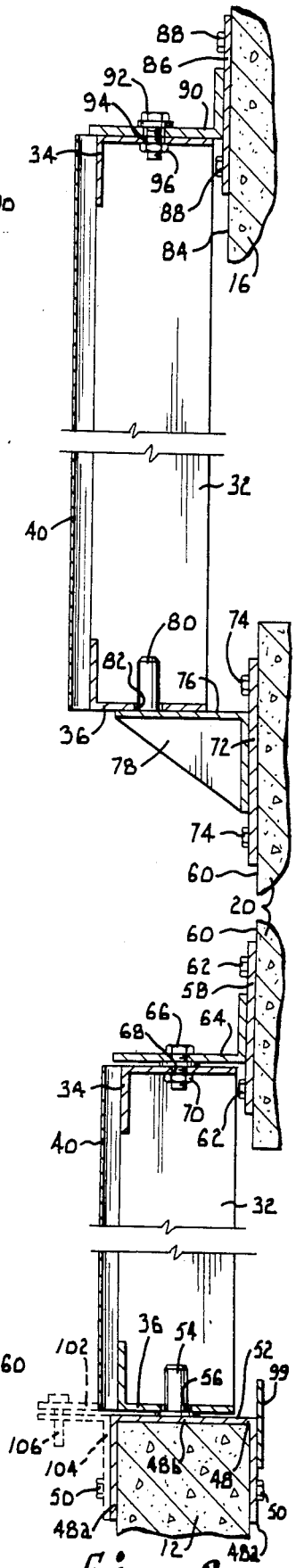
FIG. 3 is a fragmentary sectional view on an enlarged scale taken generally along line 3—3 of FIG. 1 in the direction of the arrows, with the break lines indicating continuous length of the louver panels.

The louvers 30 in each of the upper and lower courses are mounted side by side on the cooling tower 10 in the manner best shown in FIG. 3. A metal channel 48 is secured to the curb 12 by concrete anchor bolts 50. The concrete anchors 50 are extended through the flanges **48*a* of the channel and into the concrete curb 12 in order to secure the plate or web 48*b* of the channel on top of the upper surface 52 of the curb. Vertical pins 54 extend upwardly from web 48*b* at positions to fit through openings 56 which are formed in the bottom angle 36 of each louver. The openings 56 are located near the opposite ends of each angle 36. In this manner, each louver 30 in the lower course of louvers is supported on the top surface of the curb 12. The louvers can be installed on pins 54 by lowering them onto web 46 in positions to extend the pins through openings 56**.

Near the top end of each louver 30 in the lower course, a flat metal plate 58 is secured to the outer face 60 of the intermediate beam 20. Concrete anchor bolts 62 may be used to secure the mounting plate 58 to beam 20. A plurality of angle brackets 64 are welded or otherwise secured to the face of the mounting plate 58. The flange of each bracket 64 overlies the top angle 34 in the louver, and one of the brackets 64 is located near each end of each of the angles 34. A bolt 66 is extended downwardly through bracket 64 and through a bolt hole 68 formed in the underlying angle 34. The bolts 66 are threaded through nuts 70 which are welded to the lower surface of each angle 34 near its opposite ends. The two bolts 66 for each louver are aligned directly above the two pins 54 for the louver.

With reference additionally to FIG. 2, the louvers 30 in the upper course are mounted in a similar manner to the outer faces of the intermediate beam and the parapet 16. A mounting plate 72 is secured to the outer face 60 of beam 20 at a location above and parallel to plate 58. Anchor bolts 74 or other suitable fasteners are used to secure plate 72 in place. A plurality of angle brackets 76 are welded or otherwise secured to plate 72. Each angle bracket 76 is reinforced by a gusset plate 78, and each bracket 76 has an upwardly projecting pin 80. A pair of the brackets 76 underlie the opposite end portions of each of the lower angles 36 in the upper louvers 30, and pins 80 project through openings 82 formed through angles 36 near their opposite ends. The upper louvers 30 are thus supported on the angle brackets 76.

The parapet 16 is provided on its outer face 84 with a mounting plate 86 secured by anchor bolts 88. A plurality of angle brackets 90 are welded to the face of plate 86, with two of the brackets 90 overlying the opposite end portions of the upper angle 34 in each louver 30 in the upper course. A bolt 92 is extended through each bracket 90 and through an opening 94 in the underlying angle 34. Each bolt 92 is threaded through a nut 96 welded to the bottom surface of angle 34. The two bolts 92 for each louver in the upper course of louvers are aligned above the corresponding pins 80. Preferably, the louvers in the upper course are mounted immediately above the louvers in the lower course. Also, the louvers overlap the intermediate beam 20 and the parapet 16. The end louvers preferably overlap the columns 14 which define the opposite ends of the rectangular openings 22 and 24. As best shown in FIG. 4, the lip 46 of each louver covers the small gap 98 which is formed between each adjacent pair of louvers due to the louvers being spaced slightly apart.

In this manner, the louvers 30 in each course cooperate with one another to cover the openings 22 and 24 and the slats 26. The sheets 40 which form the facings of the panels preferably occupy a common (typically inclined) vertical plane which extends across the outer faces of the intermediate beam 20 and the parapet 16 and above curb 12.

Installing the louvers 30 in the manner described above retains them in the closed position in which the air spaces 28 are completely blocked. Each louver 30 can be pivoted to an open position by first removing one of the bolts 66 or 92 and cutting the pin 54 or 80 which directly underlies the bolt that is removed. Then, the louver 30 can be pivoted to its open position about a vertical pivot axis. The pivot axis for each of the louvers 30 in the lower course is defined by the remaining pin 54 and the remaining bolt 66, while the pivot axis for each louver in the upper course is defined by the remaining pin 80 and the remaining bolt 92. Each louver 30 can be pivoted through an arc of 90° between the closed position shown in FIG. 4 and the open position shown in FIG. 5. In the open position, the panel and its sheet 40 are oriented perpendicular to the common plane occupied by the sheets 40 in the closed position. In the open position, the louvers 30 do not appreciably block the flow of air into or out of the air spaces 28. It should also be noted that each panel can be pivoted to any intermediate position between the fully closed and fully open positions. A stop plate 99 (FIG. 3) can be secured to the inside face of curb 12 to form a stop which prevents louver 30 from pivoting into the cooling tower.

It is also noteworthy that each louver 30 can be closed or fully or partially opened independently of the remaining louvers. Consequently, it is possible to adjust the louvers 30 in order to achieve virtually any desired flow pattern. For example, in the wintertime, it may be desirable to close or nearly close all of the louvers 30 in the lower course and to leave all or most of the louvers 30 in the upper course fully or partially open. Then, the air flow will occur entirely or at least primarily through the upper course of louvers well above the ground level. Alternatively, it may at times be desirable to open the louvers on one side of the cooling tower and to close the louvers on another side in order to take advantage of the prevailing wind conditions. Additionally, it may at times be desirable to reduce or increase the ingress of air, and this can be done by adjusting the louvers between the open and closed positions. Thus, the louvers provide for the accurate control of the air flow pattern in the cooling tower 10.

Each louver 30 can be secured in the fully open position by applying one or more braces 100 in the manner best shown in FIGS. 2 and 5. After the louver 30 has been pivoted to the fully open position, the upper brace 100 can be extended between bracket 90 and the opening 94 (FIG. 3) from which bolt 92 has been removed. Bolts such as bolt 92 can then be extended through bracket 90 and one end of the brace and through angle 34 in the other end of the brace and secured by nuts 96. Similarly, the lower brace can be installed in extension between bracket 76 and the free end of angle 36, and the brace can be bolted in place. The rigid braces then maintain the louver 30 in the fully opened position. The braces 100 can be removed, and the louver 30 can then be partially or fully closed.

It should be understood that the louvers 30 in the lower course can be braced in the open position in the same fashion.

After one of the pins 54 or 80 has been cut, the louver 30 can later be secured in the closed position in the manner best shown in FIG. 3. Each louver 30 may be provided on its bottom edge with a hasp plate 102 which projects forwardly from the face of the sheet 40. The hasp plate 102 can be bolted to the frame of louver 30 or secured in any other suitable manner. An angle bracket 104 can be secured to the outer flange of channel 48 by the anchor bolt 50 or in any other suitable manner. The angle bracket 104 is positioned such that the hasp plate 102 immediately overlies its projecting flange when the louver is closed. A removable pin 106 can be extended through the registered hasp plate 102 and bracket 104, thereby securing the bottom portion of the louver in the closed position. The top portion of the louver can be secured in the closed position by reapplying the bolt 66. Each louver 30 in the upper course can similarly be provided with a hasp plate and mating angle bracket and pin in order to secure it in the closed position following removal of one of the pins 80.

A typical cooling tower 10 can have approximately forty-five openings 22 in its lower section and the same number of openings 24 in its upper section. Typical dimensions for each opening are approximately 40 feet wide by approximately 30 feet high. Consequently, it requires approximately 14 louvers, each 3 feet wide and over 30 feet long in order to cover each opening 22 or 24. With a total of ninety openings on the cooling tower, more than 1200 louver panels are required. It is therefore important that the louvers be constructed in a manner to be easily handled and transported. The construction of the louvers 30 allows them to be stacked back to back and face to face for containerization during shipment, and the stacked panels are arranged in a compact manner to facilitate both transport and storage. At the same time, the panel construction of the louvers is economical and yet exhibits more than ample strength and durability while in service. Each louver panel can be provided with a lifting eye for the receipt of a hook so that the louver panels can be handled by a crane during installation.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, we claim:

1. In a cooling tower having a base with a curb thereon presenting a top surface, vertical columns and horizontal beams defining openings each fitted with fixed horizontal slats extending between the columns, the improvement comprising:

a plurality of substantially vertical louvers for each opening;

means for mounting said louvers side by side in extension between the beams in a manner permitting each louver to pivot about a substantially vertical axis between an open position and a closed position, said louvers cooperating in the closed position to substantially cover the opening and presenting spaces for the ingress of air between adjacent louvers in the open position; and said mounting means including for each louver a plate secured to the top surface of the curb, a pin projecting generally upwardly from said plate and connecting the louver to the plate, a bracket secured to the beam above the curb, and a fastener connecting the louver to the bracket, said fastener being aligned above the pin to establish said pivot axis about which the louver can pivot between the open and closed positions.

2. The improvement of claim 1, wherein the columns have outer faces and said louvers include end louvers for each opening which in the closed position overlap the outer faces of the columns adjacent the opening.

3. The improvement of claim 1, including for each louver:

a rigid brace; and releaseable means for connecting said brace in extension between said plate and the louver to releaseably secure the louver in the open position.

4. The improvement of claim 1, wherein said mounting means includes for each louver:

upper and lower brackets secured to the beams at locations above and below the louver, respectively; and a fastener for each bracket connecting the bracket with the louver, said fasteners being in vertical alignment with one another to establish said pivot axis for the louver.

5. The improvement of claim 4, including for each louver:

a hasp plate on the louver;

a bracket plate on a beam of the tower adjacent to the louver, said bracket plate being located to register with said hasp plate in the closed position of the louver; and releaseable means for securing said hasp plate to said bracket plate to thereby releaseably secure the louver in the closed position.

6. The improvement of claim 4, including for each louver:

a second upper bracket and a second lower bracket secured to the beams at locations above and below the louver, respectively, and offset from the first mentioned upper and lower brackets;

a releaseable fastener for connecting the second upper bracket with the louver; and a releaseable fastener for connecting the second lower bracket with the louver, said releaseable fasteners cooperating to releaseably secure the louver in the closed position.

7. The improvement of claim 6, including for each louver;

a rigid brace; and releaseable means for connecting said brace in rigid extension between one of said second brackets and the louver to secure the louver in the open position when the releaseable fasteners have been released.

8. In a cooling tower having spaced apart vertical columns and spaced apart horizontal beams defining between each pair of columns and each pair of beams a generally rectangular opening fitted with a plurality of fixed horizontal slats extending between the columns to present air spaces between the slats for the ingress of air through the opening, the improvement comprising:

a plurality of generally rectangular panels each having a rigid frame of generally rectangular shape and a generally planar sheet secured to the frame, each of said frames including top and bottom members and a pair of side members and said panels together being large enough to substantially cover the opening;

upper and lower mounting brackets for each panel;

means for mounting said upper and lower brackets to the beams; and fastening means for securing the top member of each panel to the corresponding upper bracket and the bottom member of each panel to the corresponding lower bracket, said fastening means mounting said panels side by side in extension between the beams for pivotal and independent movement of each panel between open and closed positions about a substantially vertical pivot axis defined by said fastening means, each panel blocking the ingress of air though the air spaces in the closed position and exposing the air spaces in the open position, said sheet of each panel projecting sidewardly beyond one of said side members to present a lip on the panel which overlaps an adjacent panel in the closed position.

9. The improvement of claim 8, including removable brace means for maintaining each panel in the open position.

10. Enclosure apparatus for a cooling tower having spaced apart vertical columns, spaced apart horizontal beams and a plurality of inclined slats extending between each pair of adjacent columns to present air spaces between the slats for the ingress of air, said apparatus comprising:

a plurality of panels each having a rigid rectangular frame and a substantially planar sheet secured to the frame, each panel having a length to extend between adjacent beams and each panel having a pair of vertical side edge portions;

means for mounting said panels in extension between adjacent beams with the panels arranged side by side and the sheets occupying a common plane to cooperate with one another to span the distance between adjacent columns, thereby closing said air spaced between the slats; and each panel being pivotal about a substantially vertical axis through an arc of approximately 90° to orient the sheet of the panel substantially perpendicular to said common plane to permit ingress of air past the panel and through the air spaces between the slats, said vertical axis of each panel being adjacent one of said vertical side edge portions of the panel.

11. Apparatus as set forth in claim 10, including a plurality of generally vertical flutes on each sheet.

12. Apparatus as set forth in claim 10, wherein:

each frame includes a pair of side members;

said mounting means spaces said frames apart to present a gap between the side members of adjacent frames; and said sheet of each panel extends beyond one of the side members of the frame of the panel and substantially covers said gap.

13. Apparatus as set forth in claim 10, including releaseable means for securing each panel with its sheet oriented substantially perpendicular to said common plane.

14. Apparatus as set forth in claim 13, wherein said releaseable means comprises a rigid brace for each panel.

15. Apparatus as set forth in claim 10, wherein:

the beams of the cooling tower include a base beam having a top surface and an elevated beam spaced above the base beam and having an outer face; and said mounting means mounts the panels on top of said top surface of the base beam and against said outer face of the elevated beam.

16. Apparatus as set forth in claim 15, wherein said mounting means includes:

a plate secured on said top surface of the base beam;

a pin on said plate extending upwardly therefrom and received by the panel, said pin having an axis coincident with said vertical axis;

a bracket secured to said outer face of the elevated beam; and a fastener connecting the panel to said bracket, said fastener and pin being aligned one above the other to establish said vertical axis.

17. Apparatus as set forth in claim 16, including a rigid brace for each panel, each brace being applicable to the panel to hold same with its sheet oriented substantially perpendicular to said common plane.

18. In a cooling tower having vertical columns and horizontal beams defining openings each fitted with fixed horizontal slats extending between the columns, the improvement comprising:

a plurality of substantially vertical louvers for each opening;

first and second upper brackets for each louver secured to the beam above the louver at spaced apart locations;

first and second lower brackets for each louver secured to the beam below the louver at spaced apart locations;

fasteners for the first upper bracket and the first lower bracket of each louver connecting the louver side by side with the other louvers for pivotal movement about a substantially vertical pivot axis between an open position and a closed position, said louvers cooperating in the closed position to substantially cover the opening and presenting spaces for the ingress of air between adjacent louvers in the open position; and releaseable fasteners connecting each second upper bracket and each second lower bracket with the corresponding louver in manner to secure the louver in the closed position.

* * * * *